United States Patent [19]

Duke

[11] 4,047,566

[45] Sept. 13, 1977

[54] WELL CEMENTING METHOD AND APPARATUS

[76] Inventor: John A. Duke, 418 Pamela St., Baytown, Tex. 77520

[21] Appl. No.: 662,047

[22] Filed: Feb. 27, 1976

[51] Int. Cl.[2] ..... E21B 33/16

[52] U.S. Cl. ..... 166/285; 166/155; 166/156; 166/315

[58] Field of Search ..... 166/285, 315, 290, 291, 166/70, 77, 85, 153, 155, 156, 193, 242

[56] References Cited

U.S. PATENT DOCUMENTS

| | | | |
|---|---|---|---|
| 1,866,038 | 7/1932 | Johnson | 166/291 |
| 2,615,519 | 10/1952 | Carr | 166/70 |
| 3,336,978 | 8/1967 | Hynes | 166/285 |
| 3,347,319 | 10/1967 | Littlejohn | 166/290 X |
| 3,372,751 | 3/1968 | Canut | 166/290 |
| 3,545,542 | 12/1970 | Scott | 166/155 |
| 3,616,850 | 11/1971 | Scott | 166/155 |
| 3,667,547 | 6/1972 | Ahlstone | 166/315 X |
| 3,730,267 | 5/1973 | Scott | 166/291 X |
| 3,777,819 | 12/1973 | Delano | 166/285 |
| 3,926,253 | 12/1975 | Duke | 166/70 X |

*Primary Examiner*—Stephen J. Novosad
*Attorney, Agent, or Firm*—Pravel, Wilson & Gambrell

[57] ABSTRACT

A method and apparatus for cementing well conduits in a well which is particularly advantageous when used in cementing wells having a subsea wellhead.

10 Claims, 2 Drawing Figures

WELL CEMENTING METHOD AND APPARATUS

CROSS-REFERENCE TO RELATED PATENT

This application is related to my application Ser. No. 473,487, filed May 28, 1974 now U.S. Pat. No. 3,926,253, issued Dec. 16, 1975 entitled "Well Conduit Cementing Adapter Tool".

BACKGROUND OF THE INVENTION

This invention relates to the field of cementing well conduits in a well conductor during well completion operations.

The cementing of well conduits in a well conductor is old and well known. For an example of a description and illustration of the prior art and for details of well known cementing apparatus and procedures, specific reference for incorporation herein is made to Pages 296–320 of Volume I and Pages 1890–1944 of Volume II of the "Composite Catalog of Oil Field Equipment and Services", 30th Revision, 1972–73, published by World Oil, Houston, Tex.

Known prior art methods of cementing a well conduit in a subsea well conductor included making up a tubular string from a plurality of sections of well conduit having the same size for extending the conduit from a work surface to inside a well conductor which was positioned in the earth. Since several concentrically mounted conduits may be cemented in a well conductor, this practice would include use of many sections of each size conduit as the depth of the well increased and in the case of offshore wells, as the depth of water increased. A plug container was positioned at the drilling platform at the upper end of the tubular string to provide one or more plugs for sometimes clearing drilling mud from the string before cementing and for clearing the cement from the string at the end of the cementing operation. Such a procedure would require the string to have substantially the same diameter throughout its length to permit passage of plugs having sufficient size through the entire length of the string to be cemented.

A usual practice in drilling offshore wells has been to first drive or jet into the sea floor a large conductor casing, for example of 30 inch diameter, having a casing head until the casing head rests near the floor which floor may be at a considerable depth from the work surface. A next step included concentrically mounting and cementing a plurality of conduits within the conducting casing which conduits may be, for example, 20 inches, 13⅜ inches and 9 and ⅝ inches in diameter. One example of this type of completion operation is disclosed in U.S. Pat. No. 3,847,215, issued Nov. 12, 1974 to D. P. Herd which patent is incorporated herein by specific reference. Centralizers and scratchers are often used to center the conduits and clear the well conductor of obstructions such as gelled mud, debris and filter cake. U.S. Pat. No. 3,828,852 issued Aug. 13, 1974 to Charles G. Delano discloses that it is known that a conduit may be rotated and reciprocated to prevent sticking when lowering and positioning in the well conductor.

As noted above, since a plug clears the conduit mounted in the conductor casing from cement or other fluid the plug should be substantially the same diameter as the conduit. Accordingly, the entire tubular string, which constitutes risers would also have to be a sufficient diameter to permit the cementing plug to travel from the plug retainer mounted at the drilling platform through the tubular string to the lower portion of the string in the well conductor. This type of procedure may require a large quantity of each size of conduit which is cemented in the conductor casing, as well as the length of casing forming the riser. In the case of offshore wells, this also may require supplying an excess amount of casing for use as a riser for each size of casing to be cemented. After cementing it was necessary to disassemble the riser pipe and then transport the riser casing back to store. Such efforts were expensive and delayed the resumption of drilling operation.

It is known in the art that it may take as much as a 24 hour stand-by period for the cement to set up to properly secure a conduit in a well. During this stand-by period it may be necessary for the casing and cementing crew to remain at the drilling rig to disassemble the riser, particularly in the case of an offshore rig, as well as retaining the casing elevators and casing power tongs which are used on the riser and which are usually rented on a daily basis. The use of the riser cementing method may require an additional cost of one or more days rental for the casing and cementing equipment and of the crew since the crew must wait until the cement sets up to disconnect the riser section before retrieving their equipment and leaving the work platform.

SUMMARY OF THE INVENTION

This invention relates to a new and improved method and apparatus for cementing a conduit or casing in a conductor casing.

An object of this invention is to provide a new and improved method and apparatus for reducing the quantity of each size conduit making up a tubular string which is needed to cement a conduit in a well.

Another object of this invention is to provide a method and apparatus whereby the running string for cementing different sized conduits in a subsea well may comprise standard size drilling pipe which drilling pipe may be used to cement each sized conduit in the well.

In summary, the method and apparatus of this invention comprises a plug container which is mounted with the conduit which is to be cemented in the well and a running string of standard drilling pipe connected with the plug container and extending upwardly to the work surface to reduce the number of sections of well conduits required to cement a well conduit in a well.

Another object of the present invention is to eliminate the need for numerous sizes of running strings for different size conduit casings used in completing a subsea well.

An object of the invention is to provide new and improved plugs and plug containers for cementing a well conduit or casing in place.

An object of this invention is to reduce the amount of stand-by time of a casing and cementing crew until the cement has set to secure a conduit in a well so that the crew may retrieve their tongs, casing elevators and other equipment.

A further object of this invention is to permit quick resumption of drilling after a conduit has been cemented in a well.

DESCRIPTION OF THE PREFERRED EMBODIMENT

The well conductor cementing tool plug container PR of the present invention is used for cementing well conduits C in a large conductor casing CC.

In a typical operation described above, the conductor casing, which may be of thirty inches diameter is driven or jetted into the sea floor F with the wellhead WH at or near the ocean floor. This operation is performed from a floating work surface, which in this case is a semi-submersible SS. It is understood that this operation could be performed from any other work surface such as a fixed platform, a drilling ship or a jack-up type platform. Cement 60 is used to support the conductor casing CC in the ocean floor. It is understood that the body of water W may be several hundred feet deep.

Another step in the completion of a well to which this invention is directed, includes drilling bore 61 through the conductor casing for the step of inserting of a casing or conduit C through the conductor casing. The conductor casing C may be run from the work surface of the semi-submersible and supported in the conductor casing by hanger H. The hanger H may be of conventional construction of the type generally used in supporting casings in a well.

A critical step in completing a well so that production can be obtained from a producing formation 62 is cementing of the conductor C with the wellhead. This involves pumping cement through the conduit into the annulus 63 formed by the bore 61 and the conduit.

Figure 2:
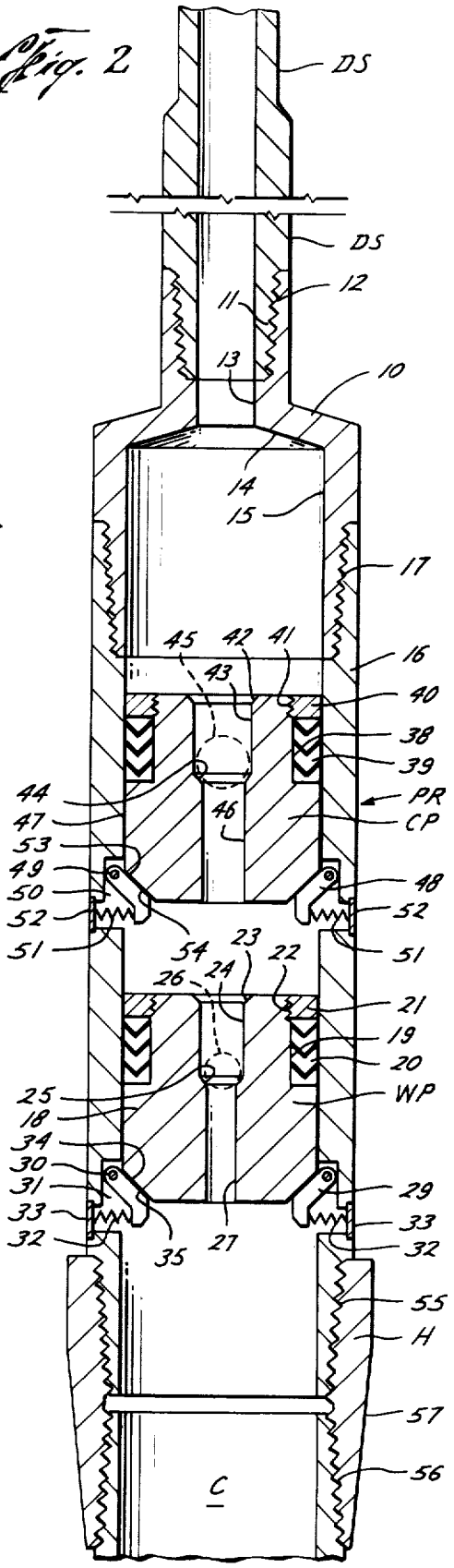
FIG. 2 is a cross section of the plug retainer and plugs.

New and improved plug container PR which is used in performing the method of this invention is best shown in FIG. 2. This plug container includes an upper housing section 10 having threaded connection 11 which is threadably mounted with a threaded connection 12 of a drill string DS which may be supported from work surface. The upper housing portion has a first passageway 13 which has substantially the same diameter as the drill string and an expanded portion 14 extending to the inner surface 15 of the upper housing section. The upper housing section is connected to a lower housing section 16 by threaded connection 17. Lower housing section serves as a mount for the cementing plug CP and the wiper plug WP.

The wiper plug WP includes a body section 18 having a stepped down portion 19 about the outer circumference of the body. A seal 20 is positioned in the stepped down portion and held in place by a retaining ring 21 that is threadably mounted at 22 to the wiper plug body. The wiper plug includes a passageway extending therethrough and having a flared portion 23 and upper portion 24. The upper portion 24 extends to a seating portion 25 which gradually decreases the size of the upper passage and which forms a seat for a blocking means such as a ball 26. The seat 25 extends to a lower portion 27 completing the passage through the wiper plug. The wiper plug outer surface 28 has a diameter slightly less than the inner diameter of the plug container as well as slightly less than the inner diameter of the conduit C to allow movement of the plug through the plug container and conduit.

A ball 26 (shown in broken lines) which is made of resilient material seats on the seat portion 25 when it is pumped through the drill string and plug retainer by pressurized fluid. As will be explained hereinafter, at a certain pressure, the resilient ball will be forced through the lower portion 27 of the passage to open the passageway through the wiper plug. The wiper plug is secured with the lower housing section by a plurality of locking dogs 29 which are pivotally mounted on pins 30 in recesses 31 in the lower housing. A back-up string 32 is connected with each of the pivoted locking dogs and is engaged by a removable screw plug 33 which is threadably mounted with the housing 16. Camming surface 34 on each locking dog engages a bevelled portion 35 on the wiper plug. In operation, the ball 26 is pumped through the drill string through a passage in the cementing plug CP to seat on the seat 25 of the wiper plug passage to block the passage. The fluid under pressure pumped through the drill string will act against the wiper plug to bias the springs 32 and dogs inwardly 29 to release the wiper plug. Typically, the wiper plug is pumped ahead of cement to prevent contamination of the cement while clearing drilling mud from the conduit C. The wiper plug engages stops 36 which may be part of a cementing shoe on the lower end of the conduit C to limit its downward travel. It is at this point that increased pressure of the cement will force the resilient ball 26 through the lower passage 27 to allow cement to pass to the annulus 33. Although only two locking dogs are shown in the drawing, it is understood that several may be used as needed to releasably secure the wiper plug with the plug container housing. In addition, a barrier type screen (not illustrated) may be positioned below the stop 36 and above a float collar and a guide shoe to retain the ball thereabove if it is desirable to employ the known float collar and guide shoe in the cementing operation.

The cementing plug CP having a body portion 37 is releasably secured with the housing 16 above the wiper plug. The cementing plug like the wiper plug has a stepped down portion 38 upon which is mounted a seal 39. The seal is held in place by a retaining ring 40 which is threadably mounted at 41 with the cementing plug body. The seal serves to prevent passage of fluid between the cementing plug body and the plug container housing as well as between the cementing plug body and the conduit C. The outer diameter of the cementing plug is the same as the wiper plug.

The cementing plug includes a passageway extending therethrough having a first flared portion 42 and an upper portion 43. The upper portion 43 extends to a seat portion 44 having a gradually decreasing diameter which forms a seat for a ball 45 which acts to seal the passage. Lower portion 46 of the passage completes the passage through the cementing plug. As noted above, outer surface 47 of the plug body has a diameter smaller than that of the plug container housing so that the cementing plug can pass therethrough as well as through the conduit C.

Locking dogs 48 are pivotally mounted on pins 49 in recesses 50 in the lower housing section 16. The locking dogs are connected with backup springs 51 which act against screw plugs 52 and the locking dogs to bias the locking dogs inwardly. The locking dogs include a camming surface 53 contacting a bevelled portion 54 of the plug body to releasably secure the plug body with the plug container housing. Although only two locking dogs are shown, it is understood that any number could be used. Furthermore, shear pins or other suitable means may be used to hold the plug body from undesired movement.

Figure 1:
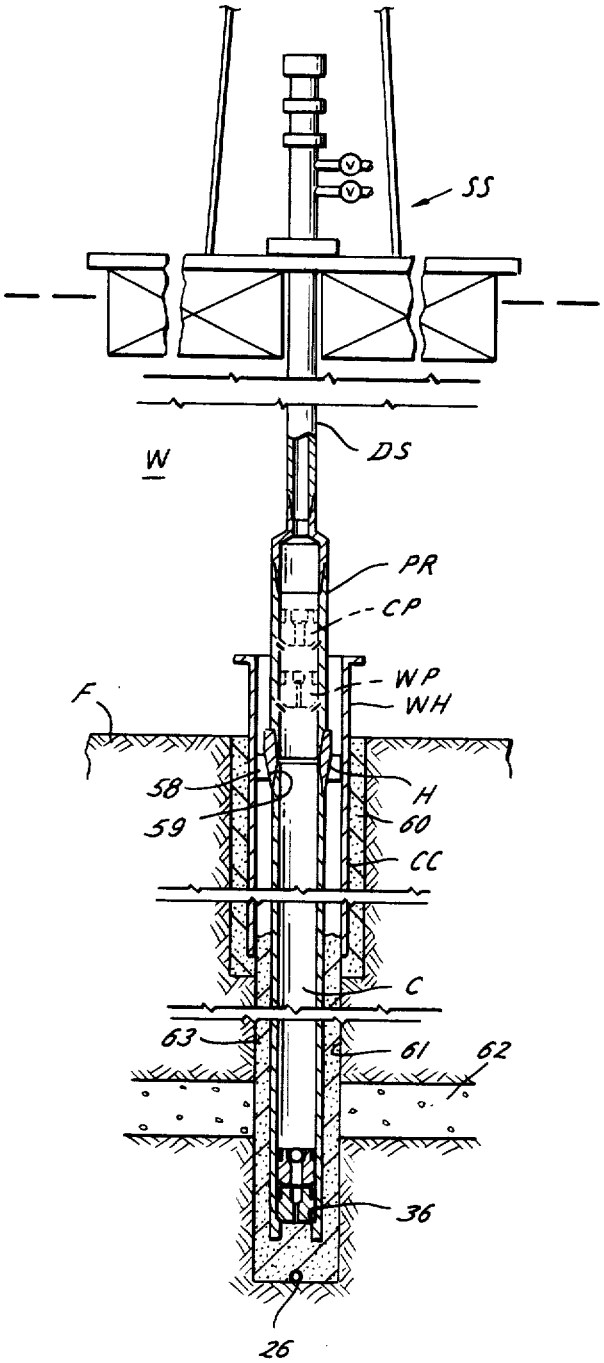
FIG. 1 is schematical view partly in cross section showing the method and apparatus for cementing.

When the ball 45 is dropped through the drill string into the plug container housing, it will seat at 44 in the cementing plug to block the flow passage through the cementing plug. The fluid then applies a pressure through the drill string to exert a downward force on the cementing plug which is sufficient to bias the dogs 48 inwardly to release the cementing plug. It will be understood that the size of the ball 45 as well as that of the ball 26 is such that it will act to prevent some contamination of the fluids in the drill string so that for instance drilling mud and cement will not be contaminated by each other and also act to clear the drill string of the fluid ahead of the ball. The lower portion 46 of the passage through the cementing plug has a diameter sufficient to allow the lower ball 26 to pass therethrough so that it may seat at 25 of the wiper plug. This facilitates release of the wiper plug by the pumping of cement through the drill string. The pressure of the cement is used to force the ball 26 through the lower portion 27 of the passage through the wiper plug when the wiper plug engages the stops at the end of the conduit. The lower end of the plug container is shown releasably mounted with right-hand screw threads 55 to that left-hand rotation of the drill string and plug retainer will unscrew the plug retainer from the casing hanger H. The threads 55 are made up and then partially backed off to insure separation of the hanger H and the plug container when a left-hand rotation is imparted to the drill string DS. The conduit C may be attached to the casing hanger by any means such as screw threads 56. The casing hanger H has a tapered lower section 57 that sets in landing lugs 58 which lugs are attached to the conductor casing CC. The tapered lower section 57 of the hanger mates with tapered landing surfaces 59 (FIG. 1) on the landing lugs 58 so that the casing hanger may be set on the landing lugs and lifted therefrom by raising the drill string. The weight of the conduit serves to hold the tapered lower section of the hanger against the tapered landing surface of the landing lugs. It should be noted that other suitable types of hanger means may be provided to support the conduit C in the conductor casing CC. Also, other suitable means may be used to connect the casing hanger with the plug retainer as well as with the conduit C.

METHOD OF OPERATION

The method of cementing the casing C in the conductor casing CC involves the initial step as set forth above of first installing the conductor casing along with the wellhead WH in the ocean floor F. The conductor casing may be cemented at 60 to secure the conductor casing with the ocean floor. The next steps involve drilling a bore 61 in the ocean floor through the conductor casing through a production formation 62. The bore 61 is drilled to sufficient size to permit insertion of the conduit C and to provide an annulus 63 between the bore 61 and the conduit C.

The conduit C is made up on the work surface from a plurality of pipe sections that are connected together to form the conduit C. The casing hanger H is connected to the upper end of the conduit C after the conduit is made up from the work surface.

The plug container PR is then connected with the casing hanger at the work surface and then partially disengaged to assure the desired release point. It is understood that the cementing plug and, if desired, a wiper plug are inserted in a plug container by disconnecting the upper housing section 15 from the lower housing section 16 at threaded connection 17. This allows insertion of one or more plugs into the plug container.

The conduit C, casing hanger H and plug container are lowered to the conductor casing by attaching a plurality of drill pipes making up a drill string DS which is supported from the work surface. Additional sections of drill pipe are added until the drill string positions the casing hanger at the landing lugs 58 in the subsea wellhead WH. The cementing apparatus is now in position to initiate the steps involved in cementing the conduit in the conductor casing.

A first step may be to pick up and reciprocate the conduit C while circulating drilling mud to clean out the annulus 63 and to allow scratchers to tear up any wall cake adhering to the bore 61 and to circulate the wall cake out of the bore. Such procedures and equipment are well known in the art. A next step involves the dropping of the first ball 26 through the passageway through the drill string and pumping cement behind the ball. Suitable valves are positioned at the work surface and connected with the drill string to allow pumping of cement through the drill string. A suitable closable inlet may be provided for inserting the balls in the drill string. The diameter of the ball 26 is sufficient to provide some separation of the mud below the ball and the cement above the ball. The ball also provides some clearing of mud from the drill string. While some contamination will result, the size of the ball 26 is such that this contamination is minimized.

Upon reaching the plug container PR, the ball 26 will be pumped through the cementing plug CP since the smallest portion 46 of the passage through the cementing plug CP is larger than the diameter of the ball 26. The ball will seat on the seat 25 of the wiper plug thus blocking the passage therethrough. Applying a first predetermined pressure to the cement which acts against the wiper plug will force the dogs 29 and backup springs 30 to be biased inwardly to release the wiper plug from the plug retainer so that it may be pumped through conduit C. The seals 20 act to prevent cement behind the plug from being contaminated by the drilling mud head of the wiper plug. Since the diameter of the conduit C is substantially the same as the plug container PR, wiper plug also acts to prevent contamination of the cement passing through the conduit C. Stops 36 on the lower portion of the conduit C act to stop downward movement of the wiper plug. Pressure on the cement being pumped into the conduit from the surface is then increased to a second predetermined pressure which is sufficient to force the resilient ball 26 through the lower portion 27 of the passage through the wiper plug. This will allow cement to pass through passageway through the wiper plug into the annulus 63. After the desired amount of cement is pumped into the annulus 63, the second ball 45 may be inserted in the drilling string at the work surface and pumped through the drill string with drilling mud or other suitable fluid pumped behind the ball to move the ball through the drill string. The ball 45 has a diameter which acts to separate the cement ahead of it from the drilling mud behind it so as to prevent contamination of the cement. This also acts to clear some of the cement from the drilling string passageway. Upon reaching the plug container PR, the ball 45 seats on surface 44 to close the passage through the cementing plug. Sufficient pressure is then applied to the drilling mud to exert a force on the cementing plug to move the dogs 50 and springs 51 inwardly to release the cementing plug from the plug retainer. Seals 39 act to prevent contamination of the cement with the drilling mud. The seals 39 also act to prevent contamination of the cement as the plug passes through the conduit C to clear the cement from the conduit C. It is understood that the drill string and conduit C may be reciprocated and rotated while cementing to prevent sticking of the conduit C in the well bore and to enhance the quality of the cementing job. The cementing plug CP is forced downwardly with the pressure of the drilling mud until it rests against the wiper plug which is resting on the stops 36 at the lower end of the conduit C.

The wiper plug and cementing plug used in this apparatus may be of drillable material should it be desirable to install additional concentric casings inside the conduit C. The setting of a plurality of casings or conduits inside a well conductor is well known and is disclosed in U.S. Pat. No. 3,847,215 as noted above. When the cement has begun to set up in the annulus 63, the drill string DS may be slacked off to set the hanger H on the landing lugs 58 in the wellhead. After the cement has set up, the plug container right-hand screw thread 55 may be backed out of the hanger H so that the plug container may be retrieved to the work surface by raising the drill string.

The same size running string may be used for running additional conduits into the well. It may be necessary, however, to use additional plugs and plug containers in accordance with the size of the conduit being cemented in the well. This reduces or eliminates the need for different sized running string for each size conduit while providing the advantages of little contamination of the drilling fluid and cement as well as clearing of the running string and conduit of fluid or cement.

Once the cement has been pumped into the annulus and the casing hanger has been set, it is necessary to wait until the cement is set with a typical setting period being twenty-four hours. Since standard drill pipes are used on the upper end of the tubular string, drill pipe or rig tongs and elevators are used to retrieve the plug container PR from the hanger H. This eliminates the need for the cementing crew to retain the special power tongs and casing elevators used to run the cemented conductor at the drill site. This equipment, often obtained on a daily rental basis, can be released as soon as the conductor is made up and is no longer needed after the cement has set up. Furthermore, the portion of the tubular string comprising the drill pipe may be used immediately when it is desired to commence drilling again after the cement sets up to install additional conduits in the well.

The foregoing disclosure and description of the invention are illustrative and explanatory thereof, and various changes in the size, shape and materials as well as in the details of the illustrated construction may be made without departing from the spirit of the invention.

I claim:

1. A method of cementing a well conduit in a well having a wellhead, comprising the steps of:

forming a well conduit to be cemented in a well at a work surface disposed above the wellhead;

mounting a hanger with the well conduit for supporting the well conduit in the well;

mounting a cementing plug container with the well conduit hanger;

connecting drill pipe with the cementing plug container to form a tubular string to support the hanger and well conduit from the work surface;

lowering the cementing plug container, hanger and well conduit by adding drill pipe to position the cementing plug container and hanger adjacent the hanger support in the well with the well conduit extending into the well;

flowing cement through the drill string, plug container, conduit hanger and conduit into the annulus between the conduit and well;

substantially clearing the conduit of cement by releasing a plug from the plug container at the hanger for movement through the well conduit;

resting the well conduit hanger on the hanger support in the well;

disconnecting the plug container from the conduit hanger to allow retrieval of the plug container after the cement has set;

releasing a wiper plug at the hanger from the plug container to clear the conduit of fluid ahead of the wiper plug to prevent contamination of the cement; and the step of releasing the wiper plug includes blocking a flow passage in a wiper plug to release the wiper plug ahead of said cement.

2. The method of claim 1, wherein:

the step of blocking includes dropping a blocking means through the drill string with the blocking means having a diameter sized to provide some clearing of the drill string and block the flow passage in the wiper plug.

3. The method of claim 1, wherein:

the step of blocking the flow passage in the wiper plug includes passing a blocking means through the drill string and through a flow passage in the cementing plug for substantially clearing the conduit of fluid and to seat in the flow passage in the wiper plug to release the wiper plug.

4. The method of claim 1, wherein:

the step of blocking the flow passage in the wiper plug includes dropping a resilient blocking means in the plug container to seat in the flow passage of the wiper plug; and supplying fluid at a first predetermined pressure to cause release of the wiper plug and force the wiper plug through the conduit.

5. The method of claim 4, including:

forcing the wiper plug through the conduit to engage stops at the lower end of the conduit; and supplying fluid at a second predetermined pressure to the wiper plug to force the resilient blocking means through the opening in the wiper plug to allow cement to pass through the opening to the annulus between the conduit and well conductor.

6. The method of claim 5, wherein:

the step of clearing includes dropping a second blocking means through the drill string having a diameter sized to provide some clearing of the drill string and block a flow passage in the cementing plug to release the cementing plug for substantially clearing the conduit of cement.

7. An apparatus for cementing a well conduit supported by a drill string from a work surface in a well having a wellhead, comprising:

a plurality of drill pipe having a first inner diameter suspended from the work surface and extending to a wellhead;

a cementing plug container connected to the lower end of the drill string and positioned at the wellhead;

cement plug means having a second inner diameter with means releasably mounting the plug means with the plug container;

a well conduit hanger for setting with the well connected with the plug container and positioned at the wellhead;

a well conduit having the second inner diameter connected with the conduit hanger and positioned in the well for cementing with the well;

the plug means includes a plug having a flow passage extending through the plug for clearing cement from the conduit; and the means for releasably mounting includes a plurality of spring biased fingers for retaining the plug means in the plug container.

8. An apparatus for cementing a well conduit supported by a drill string from a work surface in a well having a wellhead, comprising:

a plurality of drill pipe having a first inner diameter suspended from the work surface and extending to a wellhead;

a cementing plug container connected to the lower end of the drill string and positioned at the wellhead;

cement plug means having a second inner diameter with means releasably mounting the plug means with the plug container;

a well conduit hanger for setting with the well connected with the plug container and positioned at the wellhead;

a well conduit having the second inner diameter connected with the conduit hanger and positioned in the well for cementing with the well; and the plug means includes a lower wiper plug having a passage therethrough and an upper plug for clearing cement from the casing having a passage therethrough with the diameter of the passage through the upper plug being greater than the passage through the lower plug to permit a passage blocking means to pass through the upper plug passage and seat with and block the lower plug passage.

9. The apparatus of claim 8, including:

a passage blocking means which is resilient and has a diameter greater than the diameter of the wiper plug passage to block the wiper plug flow passage and cause the wiper plug to be released from the plug container when the blocking means seats with wiper plug and a fluid having a first predetermined pressure is applied through the drill string on the wiper plug.

10. The apparatus of claim 9, wherein:

the blocking means is a ball; and the resiliency of the ball and the relative diameters of the ball and wiper plug passage are sized to cause the ball to be forced through the passage in the wiper plug when a second predetermined pressure higher than the first predetermined pressure is applied through the drill string on the ball and when means with the conduit blocks further movement of the wiper plug through the conduit.

* * * * *